US008505228B2

(12) United States Patent
Cheng

(10) Patent No.: US 8,505,228 B2
(45) Date of Patent: Aug. 13, 2013

(54) MULTIPLE RAIL SIGHTING DEVICE

(75) Inventor: Carson Cheng, City of Industry, CA (US)

(73) Assignee: NCStar Inc., City of Industry, CA (US)

( * ) Notice: Subject to any disclaimer, the term of this patent is extended or adjusted under 35 U.S.C. 154(b) by 194 days.

(21) Appl. No.: 13/134,608

(22) Filed: Jun. 9, 2011

(65) Prior Publication Data

US 2012/0311909 A1 Dec. 13, 2012

(51) Int. Cl.
*F41C 27/00* (2006.01)

(52) U.S. Cl.
USPC ..... 42/90; 42/111; 42/124

(58) Field of Classification Search
USPC ..... 42/90, 111, 124, 141
See application file for complete search history.

(56) References Cited

U.S. PATENT DOCUMENTS

| | | | | |
|---|---|---|---|---|
| 7,444,776 | B2 * | 11/2008 | Adams | 42/127 |
| 7,971,382 | B2 * | 7/2011 | Robinson et al. | 42/75.02 |
| 7,971,384 | B2 * | 7/2011 | Lippard | 42/124 |
| 7,975,595 | B2 * | 7/2011 | Robinson et al. | 89/185 |
| 8,096,074 | B2 * | 1/2012 | Robinson et al. | 42/16 |
| 8,136,287 | B2 * | 3/2012 | Adams | 42/124 |
| D673,239 | S * | 12/2012 | Cheng | D22/109 |
| 2005/0262752 | A1 * | 12/2005 | Robinson et al. | 42/71.01 |
| 2005/0268513 | A1 * | 12/2005 | Battaglia | 42/71.01 |
| 2007/0033852 | A1 * | 2/2007 | Adams | 42/124 |
| 2009/0000173 | A1 * | 1/2009 | Robinson et al. | 42/75.02 |
| 2009/0007477 | A1 * | 1/2009 | Robinson et al. | 42/75.02 |
| 2009/0031606 | A1 * | 2/2009 | Robinson et al. | 42/16 |
| 2009/0031607 | A1 * | 2/2009 | Robinson et al. | 42/16 |
| 2009/0178325 | A1 * | 7/2009 | Veilleux | 42/117 |
| 2009/0185854 | A1 * | 7/2009 | Adams | 403/322.1 |
| 2010/0005697 | A1 * | 1/2010 | Fluhr et al. | 42/111 |
| 2010/0175299 | A1 * | 7/2010 | Lippard | 42/124 |
| 2011/0247255 | A1 * | 10/2011 | Ding et al. | 42/90 |
| 2012/0042557 | A1 * | 2/2012 | Gomez et al. | 42/90 |

* cited by examiner

*Primary Examiner* — Michael David
(74) *Attorney, Agent, or Firm* — Raymond Y. Chan; David and Raymond Patent Firm

(57) ABSTRACT

A sighting device for a firearm accessory includes a first coupling member, a second coupling member, and a multiple rail arrangement. The first coupling member is supported on an upper half portion of the firearm accessory. The second coupling member is supported on a lower half portion of the firearm accessory, and includes an elongated coupling slot formed thereon to detachably engage with a firearm rail of the firearm. The multiple rail arrangement includes a plurality of mounting rails formed on the first coupling member and the second coupling member, wherein the mounting rails allow the firearm accessory to be mounted onto at least one additional firearm accessory so as to eliminate a need to individually attach the additional firearm accessory to the firearm.

20 Claims, 4 Drawing Sheets

MULTIPLE RAIL SIGHTING DEVICE

BACKGROUND OF THE PRESENT INVENTION

1. Field of Invention

The present invention relates to a sighting device, and more particularly to a multiple rail sighting device comprising a multiple rail arrangement which enables multiple firearm accessories to be conveniently mounted onto a scope.

2. Description of Related Arts

Conventional firearm, such as a gun or a rifle, usually needs a sighting device such as a telescopic scope for assisting the shooter to accurately locate the target and perform the shooting. Conventionally, a scope is mounted onto the gun through a mounting rail provided on the gun. The scope needs to be mounted at the mounting rail for securely mounting onto the gun. The shooter is then able to utilize the telescopic scope to accomplish accurate shooting.

A problem with the traditional firearm and the scope is that when a shooter needs shooting, he or she may need more than one firearm accessory. For example, the shooter may need more than one scopes having different telescopic ability for shooting different objects. Moreover, the shooter may also need a laser locator for accurately pinpointing the target, especially targets which are positioned at a great distance from the shooter.

When the shooter needs more than one firearm accessories, the firearm accessories have to be individually mounted onto the firearm. This presents a very troublesome and inconvenient way of attaching the firearm accessories onto the firearm. More specifically, if the structure of the firearm is such that it is impossible for additional firearm accessories to be mounted thereon, the shooter has no choice but to give up using the additional firearm accessories.

SUMMARY OF THE PRESENT INVENTION

The invention is advantageous in that it provides a multiple rail sighting device comprising a multiple rail arrangement which enables multiple firearm accessories to be conveniently mounted onto a scope.

Another advantage of the invention is to provide a multiple rail sighting device comprising a multiple rail arrangement, which provides a plurality of mounting rails on the scope for allowing a corresponding number of firearm accessories to be mounted thereon respectively.

Another advantage of the invention is to provide a multiple rail sighting device comprising a multiple rail arrangement, wherein a plurality of mounting rails are formed on the scope without affecting the original structure thereof. In other words, the present invention fits a wide variety of scopes and therefore facilitates widespread application.

Another advantage of the invention is to provide a multiple rail sighting device comprising a first coupling member and a second coupling member for supporting the multiple rail arrangement, wherein the first coupling member and the second coupling member are mounted onto the scope without damaging it. In other words, there is no need to have connectors penetrating into the scope for mounting the multiple rail sight device of the present invention.

Additional advantages and features of the invention will become apparent from the description which follows, and may be realized by means of the instrumentalities and combinations particularly point out in the appended claims.

According to the present invention, the foregoing and other objects and advantages are attained by providing a sighting device for a scope which acts as a firearm accessory and is mounted on a firearm having a firearm rail, wherein the sighting device comprises:

a first coupling member supported on a upper half portion of the scope;

a second coupling member which is supported on a lower half portion of the scope, and comprises an elongated coupling slot formed thereon to detachably engage with the firearm rail of the firearm; and a multiple rail arrangement which comprises a plurality of mounting rails formed on the first coupling member and the second coupling member, wherein the mounting rails allow the scope to be mounted onto at least one additional firearm accessory so as to eliminate a need to individually attach the additional firearm accessory to the firearm.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
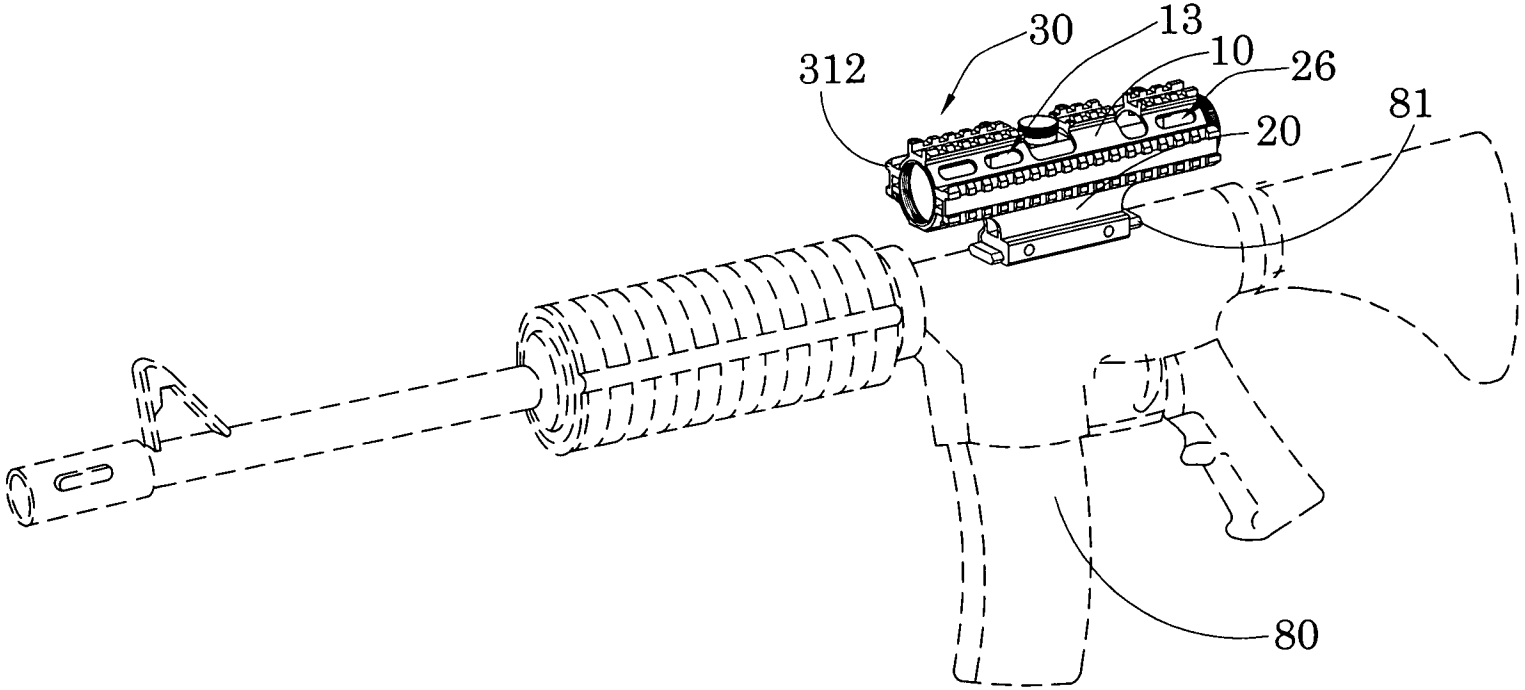
FIG. 1 is a perspective view of a multiple sighting device according to a preferred embodiment of the present invention.
Figure 2:
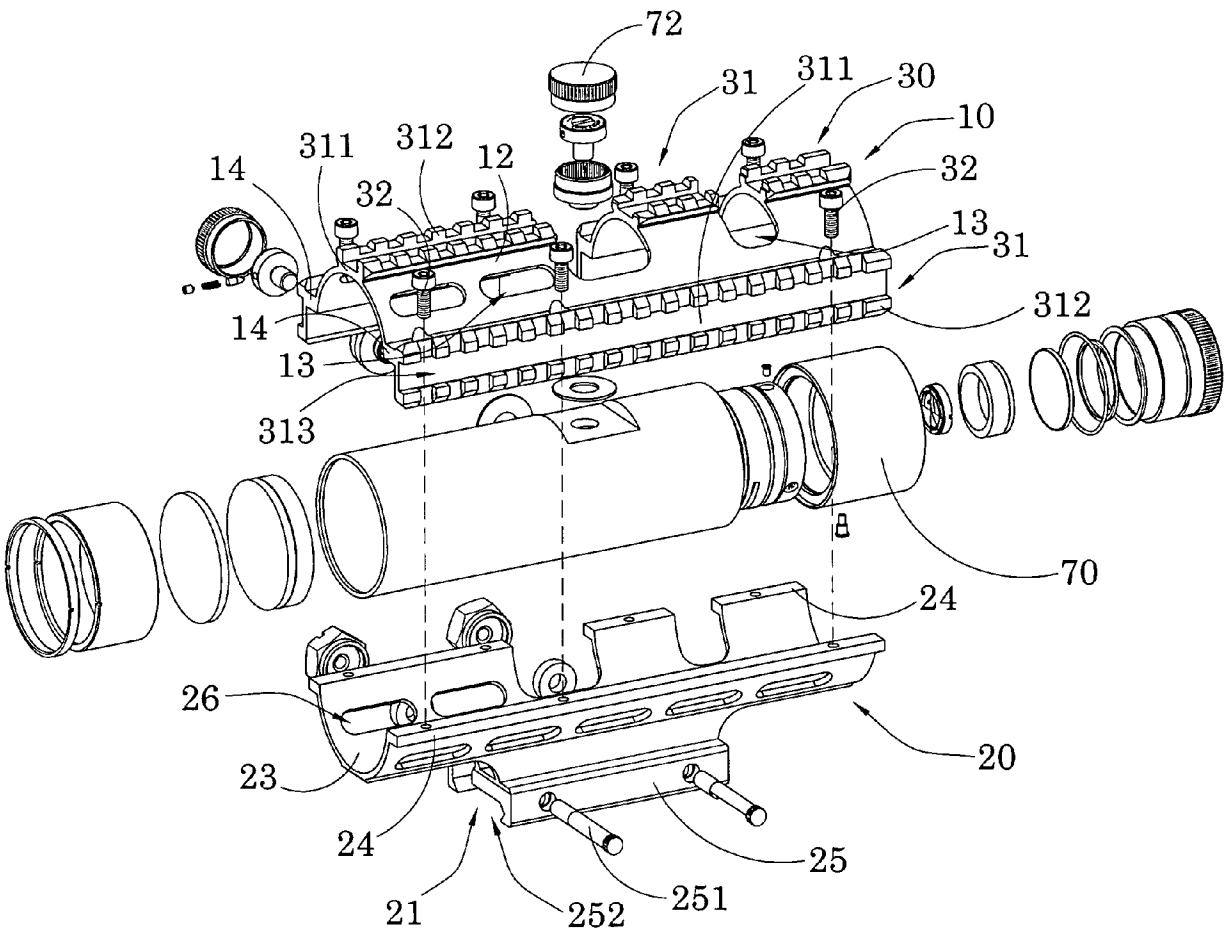
FIG. 2 is an exploded perspective view of the multiple sighting device according to the above preferred embodiment of the present invention.
Figure 3:
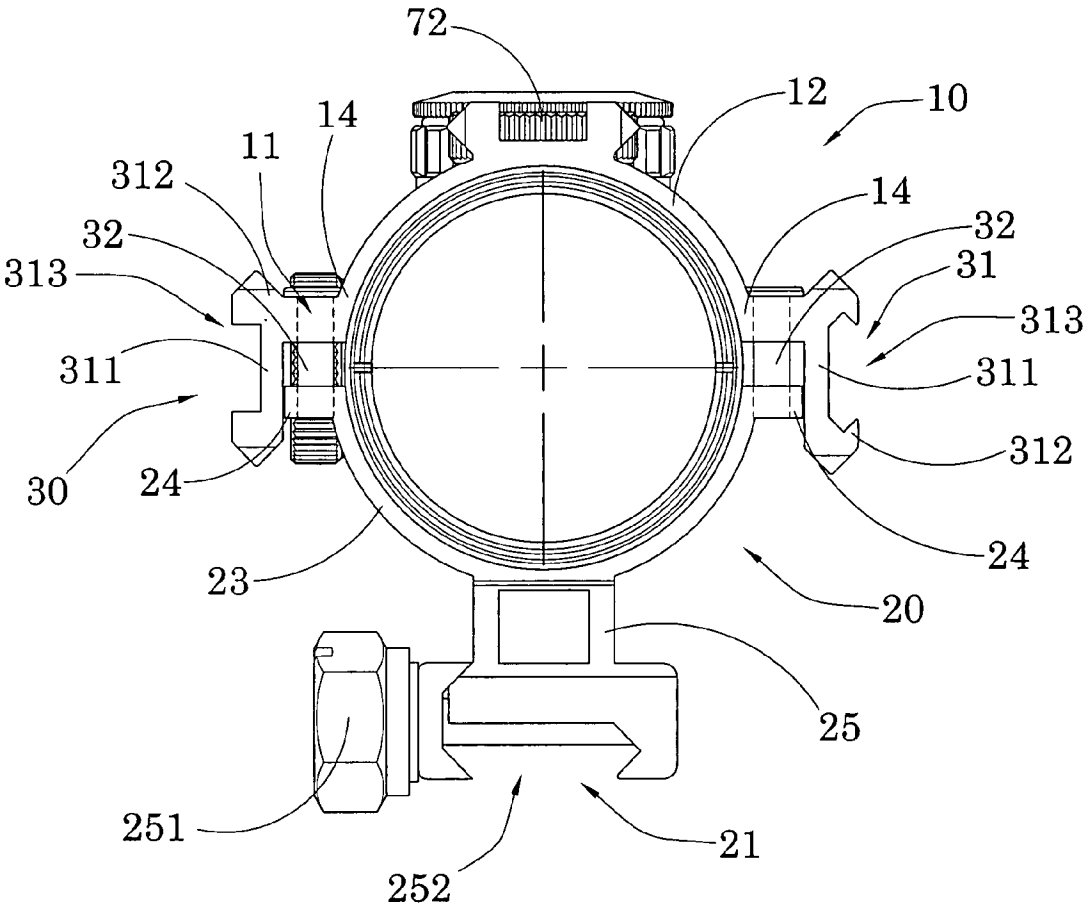
FIG. 3 is a side view of the multiple sighting device according to the above preferred embodiment of the present invention.
Figure 4:
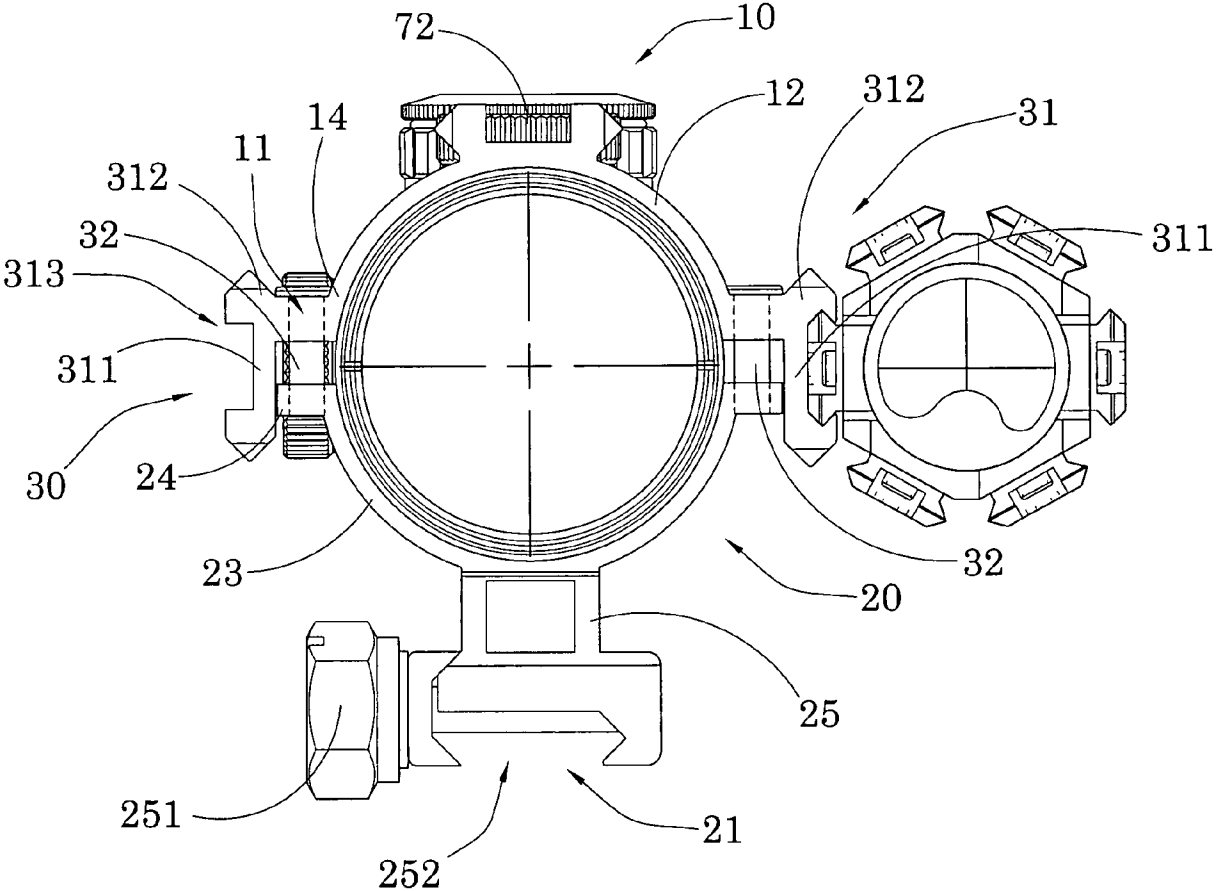
FIG. 4 is a schematic diagram of the multiple sighting device according to the above preferred embodiment of the present invention.

Referring to FIG. 1 to FIG. 3 of the drawings, a sighting device for a scope 70 of a firearm 80 (such as a rifle) according to a preferred embodiment of the present invention is illustrated, in which the sighting device comprises a first coupling member 10, a second coupling member 20 and a multiple rail arrangement 30. The scope 70 acts as a firearm accessory and is mounted on a firearm 80 having a firearm rail 81. The first coupling member 10 supported on an upper half portion of the scope 70.

The second coupling member 20 is supported on a lower half portion of the scope 70, and comprises an elongated coupling slot 21 formed thereon to detachably engage with the firearm rail 81 of the firearm 80.

On the other hand, the multiple rail arrangement 30 comprises a plurality of mounting rails 31 formed on the first coupling member 10 and the second coupling member 20, wherein the mounting rails 31 allow the scope 70 to be mounted onto at least one additional firearm accessory so as to eliminate a need to individually attach the additional firearm accessory to the firearm 80.

The first coupling member 10 comprises a first semi-tubular body 12 having a radius of curvature substantially the same as that of the scope 70, and is fittedly mounted onto the upper half portion thereof. Moreover, the first coupling member 10 has a predetermined length which covers a predetermined portion of the scope 70. The first coupling member 10 further has a plurality of first through slots 13 formed on the first tubular body 12 and aligned with a plurality of adjustment knobs 72 of the scope 70. Thus, the adjustment knobs 72 can be conveniently accessed by the shooter even though the first coupling member 10 is mounted on the scope 70. It is worth mentioning that each of the first through slots 13 may be embodied as having different shapes so as to fit different sizes and shapes of the adjustment knobs 72.

On the other hand, the second coupling member 20 comprises a second semi-tubular body 23 having a radius of curvature substantially the same as that of the lower half portion of the scope 70. The second semi-tubular body 23 is fittedly mounted onto the lower half portion of the scope 70 and is arranged to be securely mounted with the first tubular member 10 so as to fittedly and substantially embed the entire perimeter of the scope 70. Similarly, the second coupling member 20 further has a plurality of second through slots 26 formed on the second tubular body 23 and aligned with a plurality of adjustment knobs 72 of the scope 70. Thus, the adjustment knobs 72 can be conveniently accessed by the shooter even though the second coupling member 20 is mounted on the scope 70. As the first through slots 13, each of the second through slots 26 may be embodied as having different shapes so as to fit different sizes and shapes of the adjustment knobs 72.

According to the above preferred embodiment of the present invention, the multiple rail arrangement 30 further comprises a plurality of connectors 32 spacedly provided on the first coupling member 10 and the second coupling member 20 so as to securely mount the first coupling member 10 and the second coupling member 20 together on the scope 70. More specifically, each of the connectors 32 is a screw having a threaded portion formed thereon. The first coupling member 10 has a plurality of first connecting holes 11 spacedly formed thereon, while the second coupling member 20 has a plurality of second connecting holes 22 formed thereon and aligned with the first connecting holes 11 respectively, wherein each of the connectors 32 is arranged to penetrate a corresponding first connecting hole 11 and a corresponding second connecting hole 22 for mounting the first coupling member 10 with the second coupling member 20. It is worth mentioning that when connecting the first and the second coupling member 10, 20, the connectors 32 do not physically contact the scope 70 and do not in any way cause physical damage to the scope 70.

Hence, the tighter is the screwing by the connectors 32, the more secure is the connection between the first coupling member 10 and the second coupling member 20. However, the tight and secure connection between the first coupling member 10 and the second coupling member 20 does not impart any damage to the firearm accessory (i.e. the scope 70 in this preferred embodiment) because the first and the second coupling members 10, 20 are fittedly engaged with the scope 70.

As shown in FIG. 1 to FIG. 3 of the drawings, the first coupling member 10 further comprises a plurality of first mounting panels 14 transversely and outwardly extended from the first tubular body 12 at opposite sides respectively, whereas the second coupling member 20 further comprises a plurality of second mounting panels 24 transversely and outwardly extended from the second tubular body 23 at opposite sides and aligned with the first mounting panels 14 respectively. The first connecting holes 11 are spacedly formed on the first mounting panels 14 while the second connecting holes 22 are formed on the second mounting panels 24. Thus, in order to mount the first coupling member 10 with the second coupling member 20, each of the connectors 32 is arranged to pass through the first connecting hole 11 and a corresponding second connecting hole 22. Note that each of the connectors 32 has a threaded portion and the first and the second connecting holes 11, 22 are bored holes so that the connection between the first coupling member 10 and the second coupling member 20 can be tightened by screwing the connectors 32 into the first and the second connecting holes 11, 22. In other words, by tightening the first and the second coupling member 10, 20, they are securely mounted together (i.e. with respect to each other) and is peripherally mounted on the scope 70.

The second coupling member 20 further comprises a mounting base 25 provided at a bottom side of the second tubular body 23, wherein the mounting base 25 is arranged to be securely mounted onto the firearm rail 81 of the firearm 80. More specifically, the mounting base 25 comprises a plurality of connecting knobs 251 and has an engagement slot 252 formed on the bottom side of the mounting base 25 for mounting on the firearm rail 81 of the firearm 80.

Each of the mounting rails 31 of the multiple rail arrangement 30 comprises a rail base 311 protruded from the first coupling member 10, and a plurality of rail guiders 312 spacedly formed on the rail base 311 to define a rail channel 313 for an additional firearm accessory to be mounted thereon. According to the preferred embodiment of the present invention, the multiple rail arrangement 30 comprises three mounting rails 31 formed on top, and at two sides of the first coupling member 10 respectively. Thus, the first mounting pane ls 14 are protruded from two sides of the first tubular body 12 and two of the rail bases 311 are extended from the first mounting panels 14 respectively. Furthermore, the remaining rail bases 311 is extended from the top side of the first tubular body 12 for forming the corresponding rail channel 313.

It is worth mentioning that the each of the rail bases 311 extends along a longitudinal direction of the scope 70 so as to form an elongated rail channel 313. Thus, the firearm accessory is slidably engaged with the rail channel 313 for mounting onto the sighting device of the present invention.

The operation of the present invention is as follows: a user or the manufacturer of the firearm 80 may mount the sighting device of the present invention onto the firearm 80 preferably through the firearm rail 81 and the mounting base 25. After that, the user may then mount additional firearm accessory onto the plurality of mounting rails 31 so as to mount the firearm accessory such as a laser pointer or another scope 70 onto the firearm 80. The most important point is that the firearm accessories need not be individually mounted onto the firearm 80. Rather, the sighting device provides a platform for mounting many firearm accessories. The scope 70 described above is merely an example of firearm accessory and it can be embodied as different devices.

It is also worth mentioning that the exact number of mounting rails 31 provided on the first coupling member 10 can be varied according to market needs and manufacturing circumstances. Each of the mounting rails 31 can be used to mount different firearm accessory so that the shooter can utilize different firearm accessories for enhancing shooting quality.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sighting device for a firearm accessory which is mounted on a firearm having a firearm rail, wherein said sighting device comprises:

a first coupling member supported on an upper half portion of said firearm accessory;

a second coupling member which is supported on a lower half portion of said firearm accessory, and comprises an elongated coupling slot formed thereon to detachably engage with said firearm rail of said firearm; and a multiple rail arrangement which comprises a plurality of mounting rails formed on said first coupling member and said second coupling member, wherein said mounting rails allow said firearm accessory to be mounted onto at least one additional firearm accessory so as to eliminate a need to individually attach said additional firearm accessory to said firearm.

2. The sighting device, as recited in claim 1, wherein said first coupling member comprises a first semi-tubular body having a radius of curvature substantially same as that of said firearm accessory, and is fittedly mounted onto said upper half portion thereof.

3. The sighting device, as recited in claim 2, wherein said second coupling member comprises a second semi-tubular body having a radius of curvature substantially same as that of said lower half portion of said firearm accessory, wherein said second semi-tubular body is fittedly mounted onto said lower half portion of said firearm accessory and is arranged to be securely mounted with said first tubular member so as to fittedly and substantially embed said entire perimeter of said firearm accessory.

4. The sighting device, as recited in claim 3, wherein said multiple rail arrangement further comprises a plurality of connectors spacedly provided on said first coupling member and said second coupling member so as to securely mount said first coupling member and said second coupling member on said firearm accessory.

5. The sighting device, as recited in claim 4, wherein each of said connectors is a screw having a threaded portion formed thereon, wherein said first coupling member has a plurality of first connecting holes spacedly formed thereon, while said second coupling member has a plurality of second connecting holes formed thereon and aligned with said first connecting holes respectively, wherein each of said connectors is arranged to penetrate a corresponding first connecting hole and a corresponding second connecting hole for mounting said first coupling member with said second coupling member.

6. The sighting device, as recited in claim 5, wherein said first coupling member further comprises a plurality of first mounting panels transversely and outwardly extended from said first tubular body at opposite sides respectively, whereas said second coupling member further comprises a plurality of second mounting panels transversely and outwardly extended from said second tubular body at opposite sides and aligned with said first mounting panels respectively, wherein said first connecting holes are spacedly formed on said first mounting panels while said second connecting holes are spacedly formed on said second mounting panels.

7. The sighting device, as recited in claim 6, wherein each of said mounting rails of said multiple rail arrangement comprises a rail base protruded from said first coupling member, and a plurality of rail guiders spacedly formed on said rail base to define a rail channel for an additional firearm accessory to be mounted thereon.

8. The sighting device, as recited in claim 7, wherein said second coupling member further comprises a mounting base provided at a bottom side of said second tubular body, wherein said mounting base is arranged to be securely mounted onto said firearm.

9. The sighting device, as recited in claim 8, wherein said first coupling member further has a plurality of first through slots formed on said first tubular body and aligned with a plurality of adjustment knobs of said firearm accessory so that said adjustment knobs is capable of being conveniently accessed even though said first coupling member is mounted on said firearm accessory.

10. The sighting device, as recited in claim 9, wherein said second coupling member further has a plurality of second through slots formed on said second tubular body and aligned with a plurality of adjustment knobs of said firearm accessory so that said adjustment knobs are capable of being conveniently accessed even though said second coupling member is mounted on said firearm accessory.

11. The sighting device, as recited in claim 10, wherein said multiple rail arrangement comprises three mounting rails formed on a top and at two sides of said first coupling member respectively, so that said first mounting panels are protruded from two sides of said first tubular body and two of said rail bases are extended from said first mounting panels respectively.

12. The sighting device, as recited in claim 7, wherein said first coupling member further has a plurality of first through slots formed on said first tubular body and aligned with a plurality of adjustment knobs of said firearm accessory so that said adjustment knobs is capable of being conveniently accessed even though said first coupling member is mounted on said firearm accessory.

13. The sighting device, as recited in claim 8, wherein said second coupling member further has a plurality of second through slots formed on said second tubular body and aligned with a plurality of adjustment knobs of said firearm accessory so that said adjustment knobs are capable of being conveniently accessed even though said second coupling member is mounted on said firearm accessory.

14. The sighting device, as recited in claim 9, wherein said multiple rail arrangement comprises three mounting rails formed on a top and at two sides of said first coupling member respectively, so that said first mounting panels are protruded from two sides of said first tubular body and two of said rail bases are extended from said first mounting panels respectively.

15. The sighting device, as recited in claim 7, wherein said second coupling member further has a plurality of second through slots formed on said second tubular body and aligned with a plurality of adjustment knobs of said firearm accessory so that said adjustment knobs are capable of being conveniently accessed even though said second coupling member is mounted on said firearm accessory.

16. The sighting device, as recited in claim 8, wherein said multiple rail arrangement comprises three mounting rails formed on a top and at two sides of said first coupling member respectively, so that said first mounting panels are protruded from two sides of said first tubular body and two of said rail bases are extended from said first mounting panels respectively.

17. The sighting device, as recited in claim 6, wherein said second coupling member further comprises a mounting base provided at a bottom side of said second tubular body, wherein said mounting base is arranged to be securely mounted onto said firearm.

18. The sighting device, as recited in claim 6, wherein said first coupling member further has a plurality of first through slots formed on said first tubular body and aligned with a plurality of adjustment knobs of said firearm accessory so that said adjustment knobs is capable of being conveniently accessed even though said first coupling member is mounted on said firearm accessory.

19. The sighting device, as recited in claim 5, wherein each of said mounting rails of said multiple rail arrangement comprises a rail base protruded from said first coupling member, and a plurality of rail guiders spacedly formed on said rail base to define a rail channel for an additional firearm accessory to be mounted thereon.

20. The sighting device, as recited in claim 1, wherein said second coupling member further comprises a mounting base provided at a bottom side of said second tubular body, wherein said mounting base is arranged to be securely mounted onto said firearm.

* * * * *